United States Patent [19]

Hanazato

[11] Patent Number: 4,574,946

[45] Date of Patent: Mar. 11, 1986

[54] OPEN-FRONT CARTON FOR TOY VEHICLE

[75] Inventor: Hiroshi Hanazato, Tokyo, Japan

[73] Assignee: Buddy L Corp, New York, N.Y.

[21] Appl. No.: 699,932

[22] Filed: Feb. 8, 1985

[51] Int. Cl.[4] ..... B65D 5/50; B65D 85/00

[52] U.S. Cl. ..... 206/45.19; 206/45.14; 206/45.15; 206/45.16; 206/335; 206/480

[58] Field of Search ..... 206/45.14, 45.15, 45.16, 206/45.19, 335, 477, 480, 482, 45.31, 157, 193

[56] References Cited

U.S. PATENT DOCUMENTS

| | | | |
|---|---|---|---|
| 2,464,951 | 3/1949 | Stengren | 206/45.19 |
| 3,971,468 | 7/1976 | Helms | 206/193 |
| 3,998,324 | 12/1976 | Roccaforte | 206/45.14 |
| 4,089,411 | 5/1978 | Gardner | 206/482 |
| 4,185,739 | 1/1980 | Wilford | 206/335 |
| 4,391,367 | 7/1983 | Perego | 206/45.19 |
| 4,421,232 | 12/1983 | Konaka | 206/157 |

*Primary Examiner*—William T. Dixson, Jr.
*Assistant Examiner*—Brenda Ehrhardt
*Attorney, Agent, or Firm*—Michael Ebert

[57] ABSTRACT

An open-front carton for packaging and displaying a toy vehicle, the carton having an internal locking device to prevent unauthorized withdrawal of the vehicle. The carton includes a back wall, a bottom wall and a platform elevated thereabove, the vehicle being snugly received within the carton so that its inner wheels lie adjacent the back wall, and its outer wheels lie adjacent the open front. The locking device is constituted by cooperating major and minor flaps. The major flap is cut out of the platform to define a leading edge and a fold line both parallel to the rear wall, the minor flap being cut out of the bottom wall to define a leading edge and a fold line both at right angles to the back wall. The major flap is provided at its middle with a transverse slot aligned with the minor flap fold line whereby when the minor flap is folded in, it engages and raises the major flap, the leading edge of the minor flap then entering the slot to maintain this flap in an upstanding position. The leading edge of the minor flap is notched to form a rest that is engaged by the raised major flap and acts to maintain this flap at an angle to the platform, thereby creating a barrier behind the inner wheels preventing removal of the vehicle from the carton.

7 Claims, 8 Drawing Figures

Fig. 1.
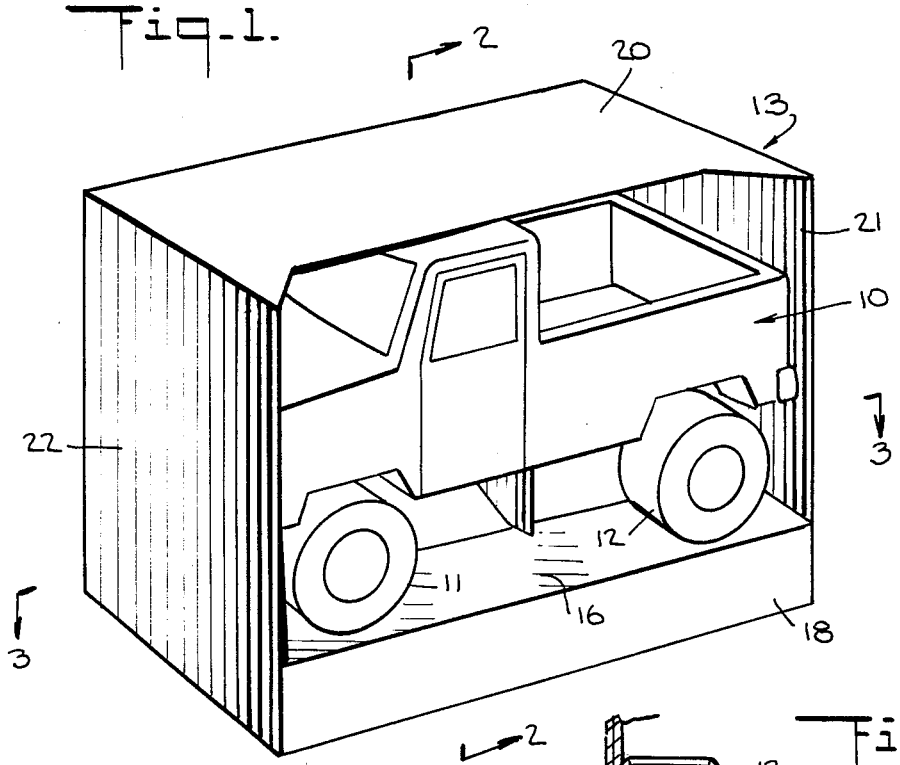
Fig. 6.
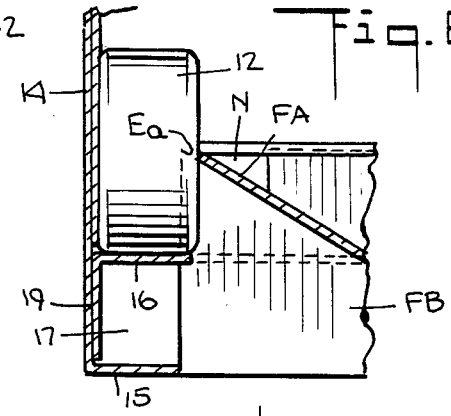
Fig. 2.
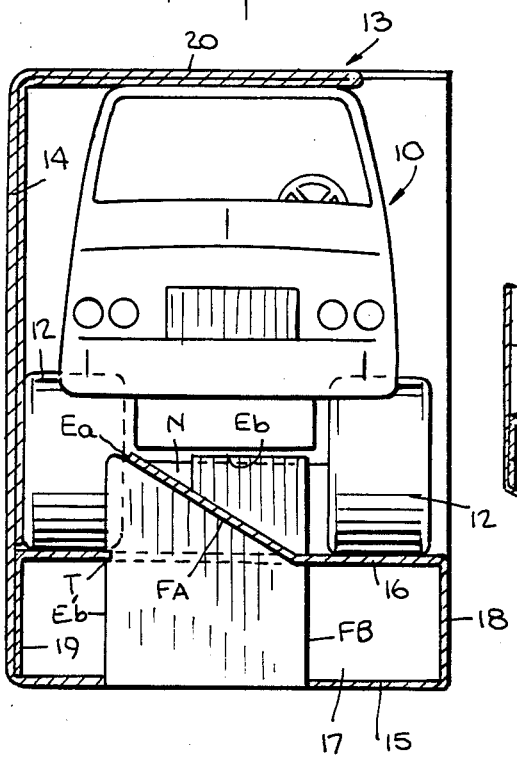
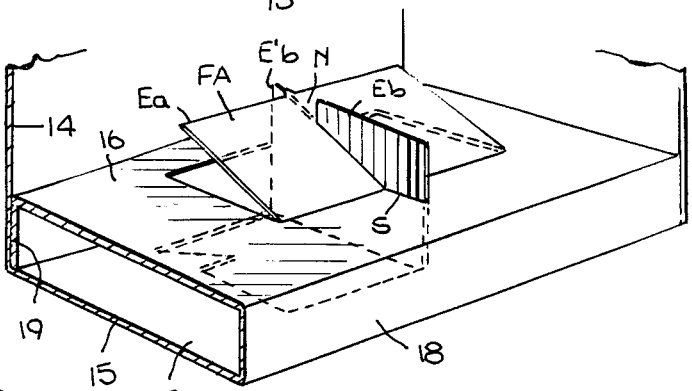
Fig. 5.

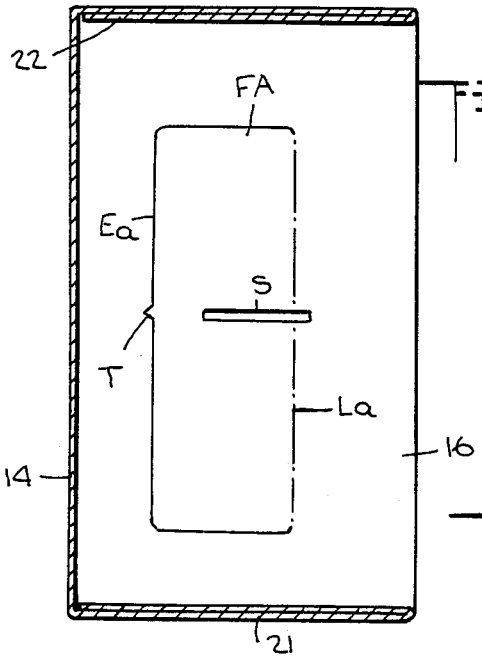
Fig. 3.
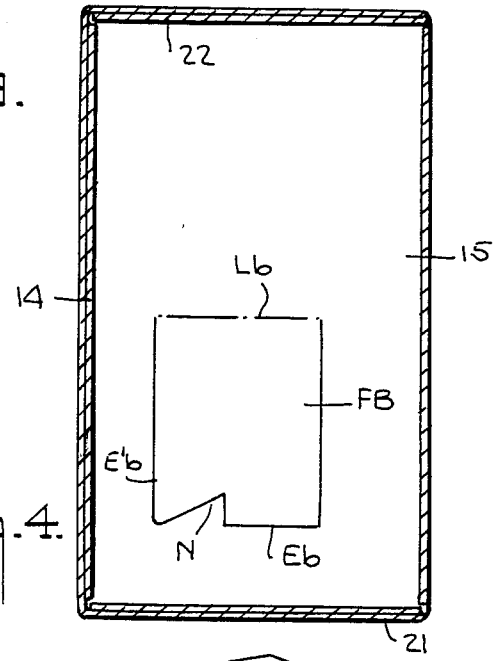
Fig. 4.
Fig. 7.
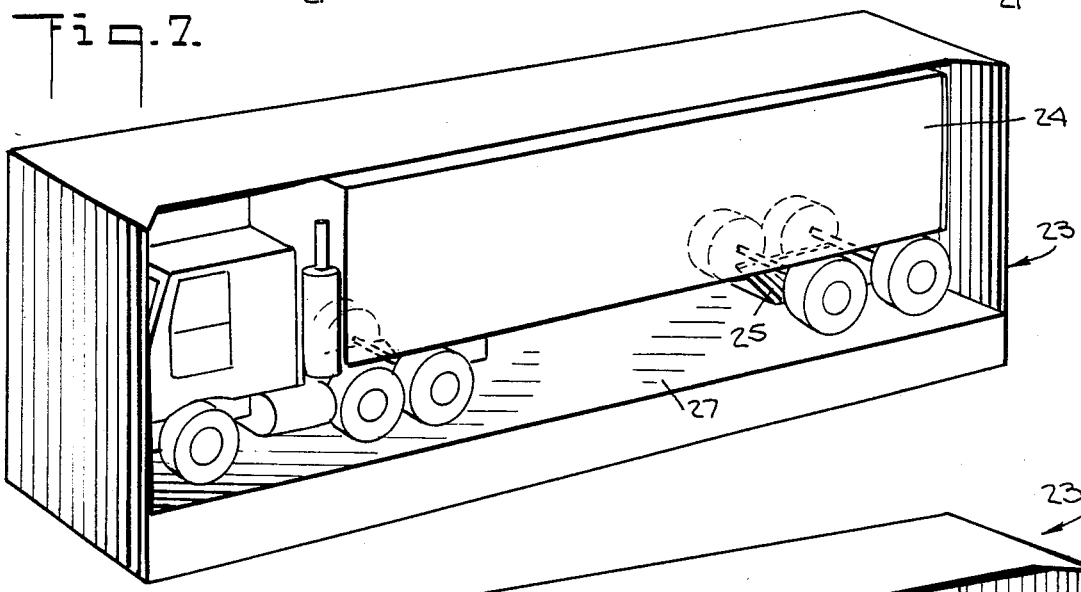
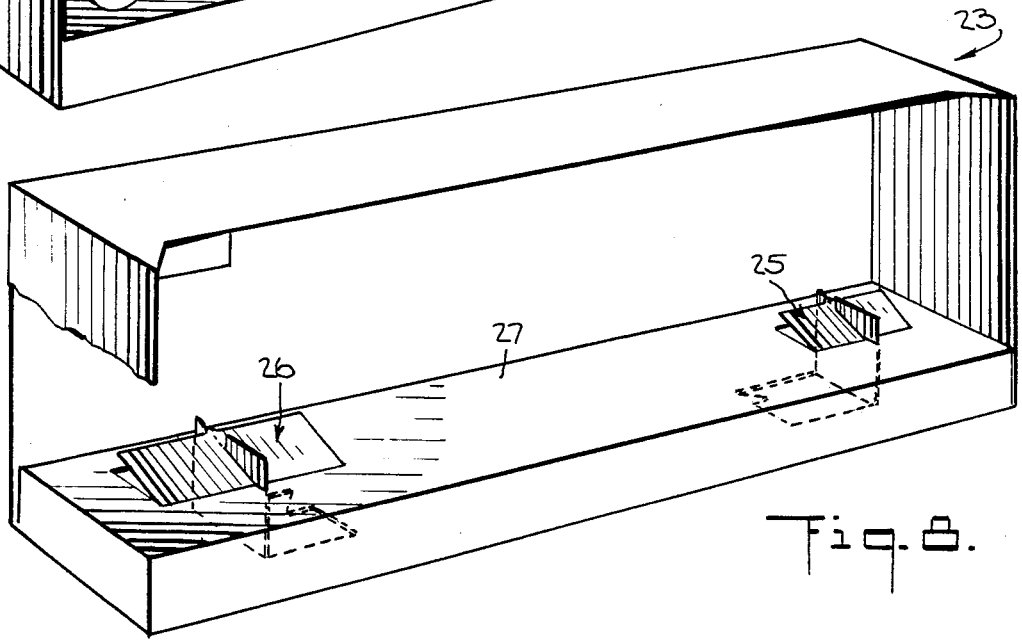
Fig. 8.

OPEN-FRONT CARTON FOR TOY VEHICLE

BACKGROUND OF INVENTION

1. Field of Invention

This invention relates generally to cartons for packaging toy vehicles, and more particularly to a carton having an open front to display the vehicle, the carton including an internal locking device which is rendered effective after the vehicle is inserted into the carton to prevent unauthorized removal thereof.

2. Background of Invention

Toy vehicles are often packaged in sealed cartons having opaque walls. Hence the actual nature of the vehicle is not evident to a prospective purchaser whose impression of the contents of the package is gained only from a representation or photograph of the vehicle on the face of the carton.

A two-dimensional photograph is incapable of doing justice to the exact nature of the vehicle, and may therefore discourage sales. It is for this reason that many toy vehicles are packaged in open-front cartons so that the prospective customer has direct access to the vehicle and is able to see exactly what is being offered for sale.

To prevent the vehicle from falling out of the open-front carton when the carton is being handled or shipped, and also to prevent unauthorized removal of the vehicle, it is necessary to provide means to securely retain the vehicle within the carton without, however, blocking the display.

To this end, the Lehner U.S. Pat. No. 3,847,276 discloses an open-front carton for a vehicle in which the carton is formed by a sheet of fiberboard provided with fold lines, making it possible to fold the sheet around a base tray. This tray is slotted to form recesses to receive the wheels of the vehicle and includes retaining ribs to hold the vehicle on the tray. One practical difficulty with the Lehner arrangement, apart from its complexity, is that the vehicle cannot be placed into a preformed carton, but must first be mounted and secured on a tray, after which the carton is erected thereabout. This assembly procedure is time-consuming and costly.

The approach to this problem taken in the Keats et al. U.S. Pat. No. 3,376,253 is much simpler, for here the toy vehicle is placed within a preformed open-front carton. The carton includes a bottom wall having a resilient flap extension that folds in to assume an angular position relative to the bottom wall, the leading edge of the folded-in flap frictionally engaging the inner wheels of the vehicle and thereby preventing its removal.

The practical drawback to the Keats et al. arrangement is that the flap position is maintained only if frictional engagement takes place. But if the inserted vehicle has wheel axle lengths resulting in a small separation between the inner wheels and the leading edge of the retaining flap, then the flap will be loose and ineffective.

SUMMARY OF INVENTION

In view of the foregoing, the main object of this invention is to provide an open-front carton for packing and displaying a toy vehicle, the carton including an internal locking device which is rendered effective after the vehicle is inserted into the carton to prevent unauthorized removal thereof.

More particularly, an object of this invention is to provide an internal locking device constituted by cooperating major and minor flaps which when erected create a stable barrier behind the inner wheels of the vehicle, the barrier being effective regardless of whether the barrier makes frictional contact with these wheels or is somewhat spaced therefrom.

While the invention will be described in the context of a toy vehicle having wheel sets, it is to be understood that it is also applicable to toy vehicles such as helicopters which have inner and outer sleds or pontoons, the barrier provided by the locking device then being behind the inner sleds or pontoons.

Also an object of this invention is to provide a carton of simple and inexpensive design which may be mass produced at low cost.

Briefly stated, these objects are attained in an open-front carton for packaging and displaying a toy vehicle, the carton having an internal locking device to prevent unauthorized withdrawal of the vehicle. The carton includes a back wall, a bottom wall and a platform elevated thereabove, the vehicle being snugly received within the carton so that its inner wheels lie adjacent the back wall, and its outer wheels lie adjacent the open front. The locking device is constituted by cooperating major and minor flaps. The major flap is cut out of the platform to define a leading edge and a fold line both parallel to the rear wall, the minor flap being cut out of the bottom wall to define a leading edge, and a fold line both at right angles to the back wall. The major flap is provided at its middle with a transverse slot aligned with the minor flap fold line whereby when the minor flap is folded in, it engages and raises the major flap, the leading edge of the minor flap then entering the slot to maintain this flap in an upstanding position. The leading edge of the minor flap is notched to form a rest that is engaged by the raised major flap and acts to maintain this flap at an angle to the platform, thereby creating a barrier behind the inner wheels preventing removal of the vehicle from the carton.

OUTLINE OF DRAWINGS

For a better understanding of the invention as well as other objects and further features thereof, reference is made to the following detailed description to be read in conjunction with the accompanying drawings, wherein:

FIG. 1 is a perspective view of a toy vehicle packaged in an open-front carton which includes an internal locking device in accordance with a first embodiment of the invention;

FIG. 2 is a transverse section taken through the carton in the plane indicated by line 2—2 in FIG. 1 to expose the locking device;

FIG. 3 is a longitudinal section taken in the plane indicated by line 3—3 in FIG. 1;

FIG. 4 is a plan view of the bottom wall of the carton;

FIG. 5 is a perspective, showing the internal locking device in its erected state;

FIG. 6 is a transverse section taken through the erected locking device;

FIG. 7 is a perspective view of another embodiment of the carton which includes a pair of internal locking devices; and FIG. 8 is a cut-away view illustrating the platform of the second embodiment and showing the internal locking devices.

DESCRIPTION OF INVENTION

First Embodiment:

Referring now to FIGS. 1 to 6, there is shown a first embodiment of a package for a toy vehicle 10 having a set of front wheels 11 and a like set of rear wheels 12, the vehicle being housed within a carton, generally designated by numeral 13, having an open front.

Carton 13, which has a box-like configuration, is constructed of a suitable low-cost, flexible material such as cardboard or chipboard. Chipboard material is easy to lithograph and therefore lends itself to printing in attractive colors. Because of the characteristic flexibility of chipboard, the flaps die-cut therein to create an internal locking device can be folded as required to assume an erected state in a manner to be later explained. In practice, single ply corrugated board or other flexible material may also be used.

Carton 13 includes a back wall 14, a bottom wall 15 and a horizontal platform 16 elevated somewhat above the bottom wall and parallel thereto to form a free space 17 therebetween. Platform 16 is formed by a foldable extension of the bottom wall which includes a front vertical ledge 18 which is exposed to a viewer, and a rear vertical ledge 19 that lies against rear wall 14, these ledges serving to support the platform.

The dimensions of the carton are such that vehicle 10 is snugly received in the open space between platform 16 and the top wall 20, the front and rear ends of the vehicle abutting the flexible end walls 21 and 22 which prevent endwise movement of the vehicle within the carton.

When vehicle 10 is in place within the carton, the inner wheels of wheel sets 11 and 12 lie adjacent rear wall 14, as shown in FIG. 2, whereas the outer wheels lie adjacent the open front, the wheels resting on platform 16. Thus the boxed vehicle is on display to a prospective purchaser.

The internal locking device for preventing unauthorized withdrawal of the vehicle from the carton is formed by a major flap FA die-cut out of platform 16, as shown in FIG. 3, which cooperates with a minor flap FB die-cut out of bottom wall 15, as shown in FIG. 4.

Major flap FA, which is generally rectangular in form, is centered within platform 16 and is created by die-cutting the platform in a pattern forming a leading edge $E_a$ in the flap and a small triangular notch T in platform 16 at the center of this leading edge so that the leading edge has a small triangular tab. The platform is scored to define the fold line $L_a$ of the major flap, so that this flap may be raised as required. Cut into major flap FA at its middle is a transverse slot S which extends through fold line $L_a$. The leading edge $E_a$ and the fold line $L_a$ of the major flap are both parallel to the rear wall 14 of the carton.

The minor flap FB, which is also rectangular, is die-cut in bottom wall 15 to create a leading edge $E_b$, the bottom wall being scored to create a fold line $L_b$. These are both at right angles to rear wall 14, fold line $L_b$ being in alignment with slot S in the major flap FA. The leading edge $E_b$ of the minor flap is provided with a triangular notch N which forms a rest.

Initially, major flap FA is co-planar with platform 16, and minor flap FB is co-planar with bottom wall 15. Hence, since the platform is initially level, there is no difficulty experienced in inserting vehicle 10 within the carton so that its wheels rest on the platform.

After the vehicle is in place, in order to render the internal locking device effective, the operator (see FIG. 2) pushes minor flap FB into free space 17 to cause the folded-in flap to engage and raise major flap FA, the leading edge $E_b$ of the minor flap then entering slot S, with the side edge $E'_b$ of the minor flap then entering notch T in the platform whereby the minor flap is held firmly in a vertical upstanding position. The raised major flap FA is seated on the rest formed by notch N in the minor flap, as shown in FIG. 6, which acts to maintain the major flap at an acute angle relative to platform 16.

As shown in FIG. 2, the leading edge $E_a$ of the inclined major flap FA is adjacent the inner wheels of the vehicle and acts therefore as a barrier or stop preventing unauthorized withdrawal of the vehicle. In practice, the dimensions of the major flap may be such as to cause the leading edge thereof to frictionally engage the inner wheels of the vehicle, but such engagement is not necessary; for even if a small space exists therebetween, the barrier created by the major flap will remain in place in that this flap, when the device is erected, is never loose and cannot return to the level of the platform.

Thus the assembly procedure is a very simple matter, for the operator has merely to insert the toy into the box through the open front thereof, and then press in the minor flap to render the locking device effective.

Second Embodiment:

In the second embodiment shown in FIGS. 7 and 8, the box-like open-front carton 23 is relatively long to accommodate a trailer truck toy 24 having several sets of wheels.

A single locking device as in the first embodiment is not sufficient in this instance to securely retain the truck in the box. For this reason, two such identical devices 25 and 26 are provided at longitudinally-spaced positions on the elevated platform 27, the first device being operative with respect to the inner wheels of a wheel set near the front of the vehicle and the second with respect to the inner wheels of a wheel set near the rear of the vehicle.

The structure and operation of these locking devices is the same as that previously described.

While there has been shown and described preferred embodiments of OPEN-FRONT CARTON FOR TOY VEHICLE in accordance with the invention, it will be appreciated that many changes and modifications may be made therein without, however, departing from the essential spirit thereof. Thus, instead of a locking device formed of a single minor flap cooperating with a major flap, a major flap may be elongated and provided with a pair of slots to receive the leading edges of a pair of spaced minor flaps, one holding up one end of the major flap and the other holding up the other end.

I claim:

1. A carton for packaging and displaying a toy vehicle having more than one set of wheels, said carton comprising:

A. a box-like structure having an open front, a back wall, a bottom wall and a platform elevated above the bottom wall to form a free space therebetween, the dimensions of the structure being such as to accommodate the vehicle in the chamber created above the platform, with the wheels thereof resting on the platform, the inner wheels being adjacent the back wall and the outer wheels adjacent the open front; and B. an internal locking device to prevent unauthorized withdrawal of the vehicle from the chamber, said device being constituted by a major flap cut out of the platform to define a leading edge and a fold line both parallel to the back wall and a minor flap cut out of the bottom wall to define a leading edge and a fold line both at right angles to the back wall, the major flap having a transverse slot therein, whereby when the minor flap is folded into the free space it engages and raises the major flap and enters the slot therein to maintain the minor flap in an upstanding position, the major flap then resting on the minor flap at an acute angle relative to the platform to form a barrier behind the inner wheels to prevent withdrawal of the vehicle.

2. A carton as set forth in claim 1, wherein said leading edge of the minor flap is provided with a notch to seat the angled major flap.

3. A carton as set forth in claim 1, wherein the boxlike structure is formed of flexible chipboard.

4. A carton as set forth in claim 1, wherein said slot is at the midpoint of the major flap.

5. A carton as set forth in claim 4, wherein the fold line in the minor flap is aligned with the slot in the major fold.

6. A carton as set forth in claim 1, wherein said platform has a notch therein aligned with the transverse slot, the site edge of the minor flap being received in said notch when the leading edge thereof enters the stop.

7. A carton as set forth in claim 1, including a pair of internal locking devices at spaced positions for preventing withdrawal of an elongated vehicle, the barrier formed by one device being disposed behind the inner wheels of the vehicle adjacent the front end and the barrier formed by the other device being disposed behind the inner wheels adjacent the rear end.

* * * * *